United States Patent [19]

Mauck et al.

[11] Patent Number: 4,944,512

[45] Date of Patent: Jul. 31, 1990

[54] GAME APPARATUS

[76] Inventors: Bonnie M. Mauck; Ronnie L. Mauck, both of 10355 Tomahawk Trail, Colorado Springs, Colo. 80908

[21] Appl. No.: 427,433

[22] Filed: Oct. 27, 1989

[51] Int. Cl.[5] ..... A63F 9/00

[52] U.S. Cl. ..... 273/1 GE; 273/1 GG; 273/DIG. 25

[58] Field of Search ..... 273/1 GE, 1 GG, DIG. 25

[56] References Cited

U.S. PATENT DOCUMENTS 3,437,337 4/1969 Larson, Jr. ..... 273/1 GE
3,841,628 10/1974 Goldfarb ..... 273/1 R
3,989,243 11/1976 Breslow ..... 273/1 R
4,327,911 5/1982 Ptaszek ..... 273/1 GE
4,773,643 9/1988 Mizunuma ..... 273/1 GE

FOREIGN PATENT DOCUMENTS 164874 1/1934 Switzerland ..... 273/1 GE

*Primary Examiner*—Paul E. Shapiro

[57] ABSTRACT

A game apparatus (10) wherein a plunger (22) is used to try to capture tethered playing pieces (18) positioned at a particular location (17) on a game board member (16) in response to the outcome of the roll of a pair of dice (30) to win other players poker chips (40).

4 Claims, 1 Drawing Sheet

FIG. 1.
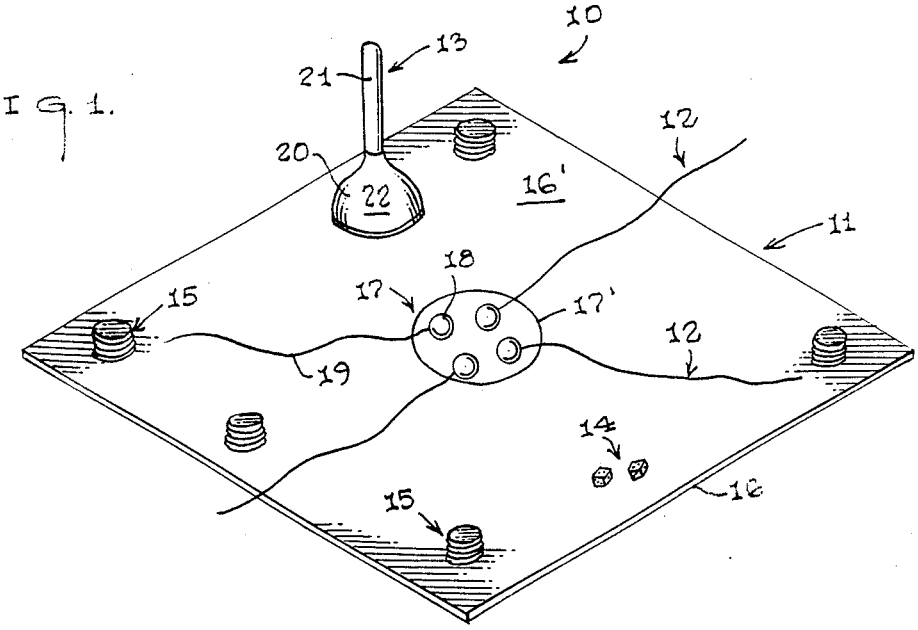
FIG. 2.
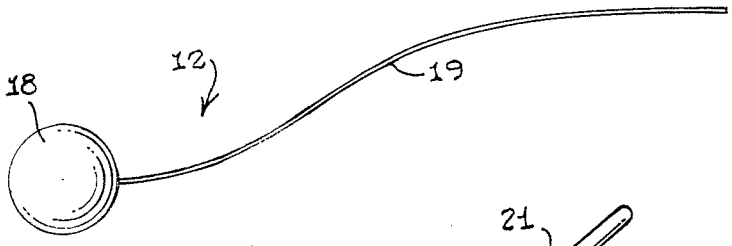
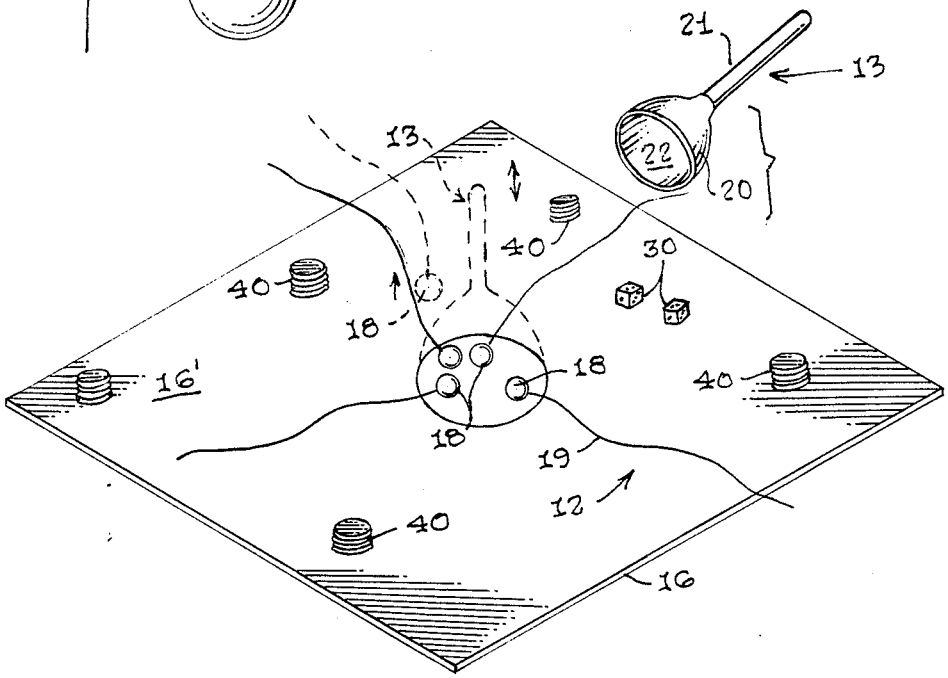
FIG. 3.

GAME APPARATUS

TECHNICAL FIELD

This invention relates to games in general, and more particularly to board games for the amusement of three or more players.

BACKGROUND OF THE INVENTION

As can be seen by reference to the following U.S. Pat. No's.: 4,327,911; 3,989,243; 4,773,643; and 3,841,628 the prior art is replete with myriad and diverse physical participation game device which are meant to be played by children and adults as well.

While the prior art constructions are more than adequate for the purpose and function for which they were specially designed, they are deficient in allowing all of the players in the game to participate in every move in an exciting and challenging way.

Most board games involve the interaction of one player at a time with the game. These types of games are generally interesting and fun, but they lack the excitement of simultaneous group involvement and competition.

While there are games that do offer this group involvement, most of these games are complicated and not easy to follow. These games also do not offer the variation of active roles for the players. The introduction of a different role for the players keeps them from getting bored and makes the participants want to play the game longer.

Therefore, there has existed a longstanding need for a new game device that can stimulate group involvement in a fashion that is very easy to understand, but which is still exciting and challenging to play; and, the provision of such a device is a stated objective of the present invention.

SUMMARY OF THE INVENTION

The object of this invention is to provide a game that will stimulate group competition in a manner that is easily understood and fun to play.

Briefly stated, the preferred embodiment of the invention comprises a game board having a generally smooth top surface with a circle imprinted in the center of the board. Each player is given a specified number of poker chips. One of the players is given a set of dice and a capture unit.

All of the other players are given a ball which is attached to a piece of elastic string. To play the game, all of the players given the ball place the tethered ball in the designated center portion of the board. The player that was given the capture unit and the set of dice rolls the dice and if a predesignated set of numbers comes up, the player with the capture unit tries to capture the balls in the center circle.

In the meantime, the other players try to get out of the circle without being caught by the capture unit by pulling on their strings. As can be appreciated thus far in the description of the game, all of the players are involved with every move; and, it is very easy to follow the basic rules that govern the way the game is played. In addition, the periodic changing of the player who holds the capture unit keeps the intrigue of the game for all of the players.

Furthermore, the winner of the game is the player that accumulates the most chips and this is accomplished when a player has to pay the handler of the capture unit when they are captured, or when they pull their ball out of the circle before the capture unit is thrust towards the game board.

Also, the handler of the capture unit must pay the other players one chip apiece when the handler is unable to capture their balls.

BRIEF DESCRIPTION OF THE DRAWINGS

These and other objects, advantages and novel features of the invention will become more apparent from the detailed description of the best mode for carrying out the preferred embodiment of this invention which follows; particularly when considered in conjunction with the accompanying drawings, wherein:

FIG. 1 is a perspective view of the invention;

FIG. 2 is a perspective view of the movable tethered unit; and,

FIG. 3 is a perspective view of the invention in use.

BEST MODE FOR CARRYING OUT THE INVENTION

As can be seen by reference to the drawings and in particular to FIG. 1, the game apparatus that forms the basis of the present invention is designated generally by the reference numeral (10). The apparatus (10) comprises in general: a board unit (11); a plurality of moveable tethered units (12);a capture unit (13); a die unit (14) and token units (15). These units will now be described in seriatim fashion.

As can best be seen by reference to FIGS. 1 and 3, the board unit (11) comprises a generally flat rectangular game board member (16) having a centrally located starting location (17) imprinted or otherwise designated on the top surface (16') of the game board member (16). In the preferred embodiment depicted in the drawings the starting location (17) is designated as a circle (17'); however, it is to be understood that other geometric patterns could be employed in keeping with the teachings of this invention.

Turning now to FIG. 2, it can be seen that the moveable tethered units (12) each comprise a spherical playing piece (18) attached to one end of an elongated flexible elastic tether (19); wherein, the other end of the tether (19) is intended to be grasped by a player during the course of the game to move the playing piece (18) away from a designated portion of the game board member (16), as will be explained in greater detail later on in the specification.

Returning to FIGS. 1 and 3 it can be seen that the capture unit (13) comprises an inverted receptacle member (20) equipped with a handle element (21) wherein the inverted receptacle member (20) is dimensioned to cover a preselected portion of the game board member (16), such as the starting circle (17') to capture the playing pieces (18) before they can be moved outside of the starting circle (17') by manipulation of the tether (19) by the other players. In addition, in the preferred embodiment of the invention depicted in the drawings the receptacle member (20) comprises a resilient plunger element (22) as commonly referred to as a "plumbers helper" .

Still referring to FIGS. 1 and 3, it can be seen that the die unit (14) comprises a conventional pair of dice (30) and the token units (15) comprise a stack of chips (40)of any desired number equally divided among the players of the game.

By now it should be apparent that the general rules governing the game involves the attempt by one player to capture as many of the playing pieces (18) as possible on the game board surface (16') with the capture unit (13); while the other players attempt to avoid capture.

By way of explanation, the reader's attention is directed to FIG. 3 wherein the solid line portion reflects the position of the game apparatus (10) prior to the game beginning and the dashed line portion represents the position of the playing pieces (18) and (18') after the capture unit (13) has been engaged with the game board member (16). In this example three of the players have had their playing pieces (18) captured by the player who controls the capture unit (13) while only the player controlling playing piece (18')has been able to escape.

Obviously many different rules may be developed to govern how this game apparatus (10)is to be played; however, what follows is considered to be the preferred general format for the rules.

Each player starts out with 10 poker chips. Player #1 holds onto the dice and the plunger. All other players place a ball in the circle and hold onto their string.

To start play:

Player #1 rolls the dice while holding the plunger on the board. If the dice add up to 7 or 11 he tries to capture the balls in the circle. The players he captures pay the plunger one chip each. The players who get away without being captured each receive a chip from the plunger. If a person pulls their ball out of the circle on anything but 7 or 11 he must pay the plunger a chip. The plunger can try to fake a plunge to make other players jumpy. If the plunger happens to plunge the balls when the dice do not add up to 7 or 11 he must pay a chip to each person he plunged. If the dice do not add up to 7 or 11 player #1 simply passes on the plunger and dice to the next player who hands player #1 his ball. The game is over when one player is out of chips and owes one. The player with the most chips is the winner.

Optional rules are as follows:

If the plunger rolls doubles he rolls again; other numbers may be substituted or added for 7 and 11. Example: 5, 7, 11 or 6, 9 or 3, 8, 10; and, you can also play with 3 dice and plunge on doubles and triples.

Having thereby described the subject matter of this invention it should be apparent that many substitutions, modifications and variations of the invention are possible in light of the above teachings. It is therefore to be understood that the invention as taught and described herein is only to be limited to the extent of the breadth and scope of the appended claims.

We claim:

1. A game apparatus consisting of:

a generally flat rectangular game board having a starting location designated on the top surface of the game board;

a plurality of tethered units each comprising a spherical game piece attached to one end of an elongated elastic tether; and, a capture unit comprising an inverted receptacle member dimensioned to cover a portion of the top surface of the game board, and having a handle element; whereby, the spherical configuration of the game piece will prevent the game piece from becoming caught between the periphery of said inverted receptacle member and the game board.

2. The apparatus as in claim 3 wherein the receptacle member comprises a resilient plunger element.

3. The apparatus as in claim 2 wherein said starting location is designated as a circle formed proximate the center of the top surface of the playing board.

4. The apparatus as in claim 3 further comprising:

a die unit; and, token units.

* * * * *